US008038349B2

(12) United States Patent
Andersson et al.

(10) Patent No.: US 8,038,349 B2
(45) Date of Patent: Oct. 18, 2011

(54) FLEXIBLE PACKAGE AND METHOD OF PRODUCING THE SAME

(75) Inventors: Thomas Andersson, Mörarp (SE); Carl-Olof Norlin, Strövelstorp (SE)

(73) Assignee: Regath HB, Helsingborg (SE)

( * ) Notice: Subject to any disclaimer, the term of this patent is extended or adjusted under 35 U.S.C. 154(b) by 1012 days.

(21) Appl. No.: 11/886,575

(22) PCT Filed: Apr. 11, 2006

(86) PCT No.: PCT/EP2006/003326

§ 371 (c)(1),
(2), (4) Date: Sep. 18, 2007

(87) PCT Pub. No.: WO2006/108614

PCT Pub. Date: Oct. 19, 2006

(65) Prior Publication Data

US 2009/0028472 A1 Jan. 29, 2009

(30) Foreign Application Priority Data

Apr. 15, 2005 (EP) ..... 05008246

(51) Int. Cl.

| | |
|---|---|
| ***B65D 33/00*** | (2006.01) |
| ***B65D 33/16*** | (2006.01) |
| ***B65D 33/02*** | (2006.01) |
| ***B65B 61/18*** | (2006.01) |
| ***B65B 61/20*** | (2006.01) |

(52) U.S. Cl. ..... 383/205; 383/203; 383/207; 383/66; 383/107; 383/119; 53/412; 53/133.1; 53/133.6; 53/133.7

(58) Field of Classification Search ..... 383/66, 383/203, 205, 207, 208, 119, 107; 229/87.05; 53/412, 451, 133.4, 133.8, 551, 133.6, 133.7
See application file for complete search history.

(56) References Cited

U.S. PATENT DOCUMENTS

| | | | | |
|---|---|---|---|---|
| 3,505,779 | A * | 4/1970 | Kopp | 53/550 |
| 4,192,420 | A * | 3/1980 | Worrell et al. | 206/205 |
| 4,420,080 | A | 12/1983 | Nakamura | |
| 4,917,247 | A * | 4/1990 | Jud | 383/207 |
| 5,018,625 | A * | 5/1991 | Focke et al. | 229/87.05 |
| 5,096,113 | A * | 3/1992 | Focke | 229/87.05 |

(Continued)

FOREIGN PATENT DOCUMENTS

JP 08207964 A * 8/1996

(Continued)

*Primary Examiner* — Jes F Pascua
(74) *Attorney, Agent, or Firm* — Birch, Stewart, Kolasch & Birch, LLP

(57) ABSTRACT

The invention relates to a flexible package (1) formed by a wrapped material having a first longitudinal joint (4) comprising two longitudinal edge portions of the wrapped material. The package (1) also has a first and a second transverse joint (5, 6), each comprising a transversal edge portion of the wrapped material. The package (1) comprises a pocket defined by said wrapped material, an openable flap (11) defined by an indication (10) and a label (12) fixed to the openable flap (11) and provided with a tab (14) for opening the package (1) along the indication (10). The package (1) is characterised by a first and a second longitudinal stiffener (3) being formed by said wrapped material and that said label (12) is adhesively fixed to at least one of said first and second longitudinal stiffeners (3). The invention also relates to a method of producing such package.

22 Claims, 6 Drawing Sheets

U.S. PATENT DOCUMENTS 5,100,003 A * 3/1992 Jud ..... 229/87.05
5,167,455 A * 12/1992 Forman ..... 383/66
5,333,735 A * 8/1994 Focke et al. ..... 206/494
5,439,102 A * 8/1995 Brown et al. ..... 206/63.3
5,862,652 A 1/1999 Schoeler
5,897,210 A * 4/1999 Giblin et al. ..... 383/98
6,309,105 B1 10/2001 Palumbo
6,428,456 B1 * 8/2002 Visona' et al. ..... 493/133
6,513,308 B1 * 2/2003 Meeuwesen et al. ..... 53/551
6,726,014 B2 * 4/2004 Laurent ..... 206/494
6,729,112 B2 * 5/2004 Kuss et al. ..... 53/551
6,865,860 B2 * 3/2005 Arakawa et al. ..... 53/412
7,770,362 B2 * 8/2010 Koehn ..... 53/459

FOREIGN PATENT DOCUMENTS

WO WO-86/06350 A1 11/1986

* cited by examiner

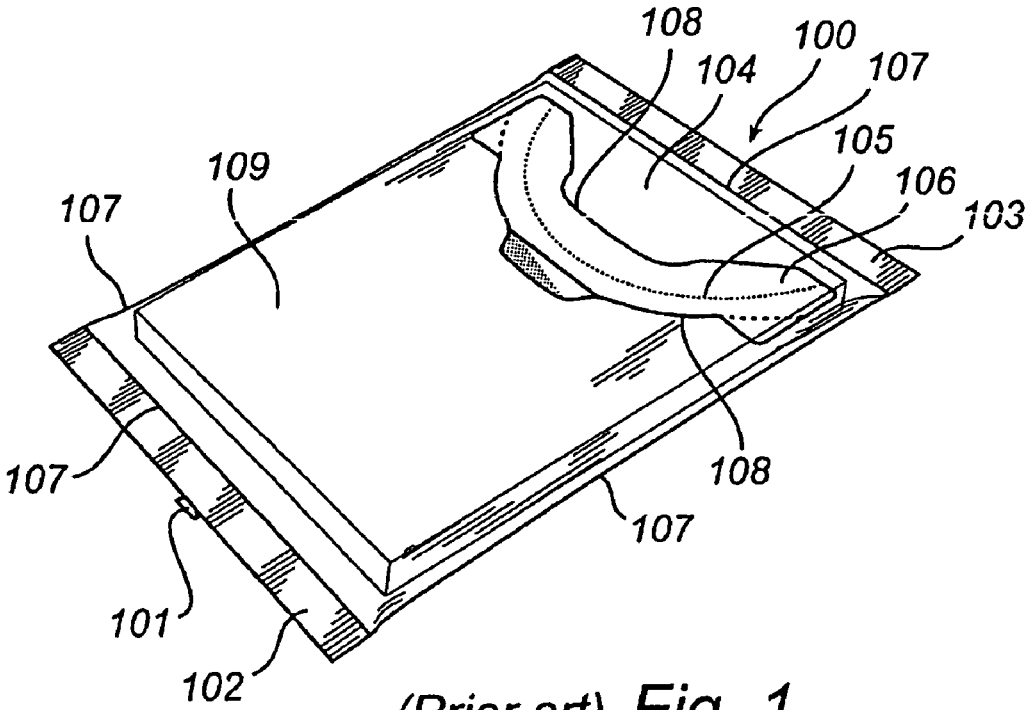
(Prior art) Fig. 1
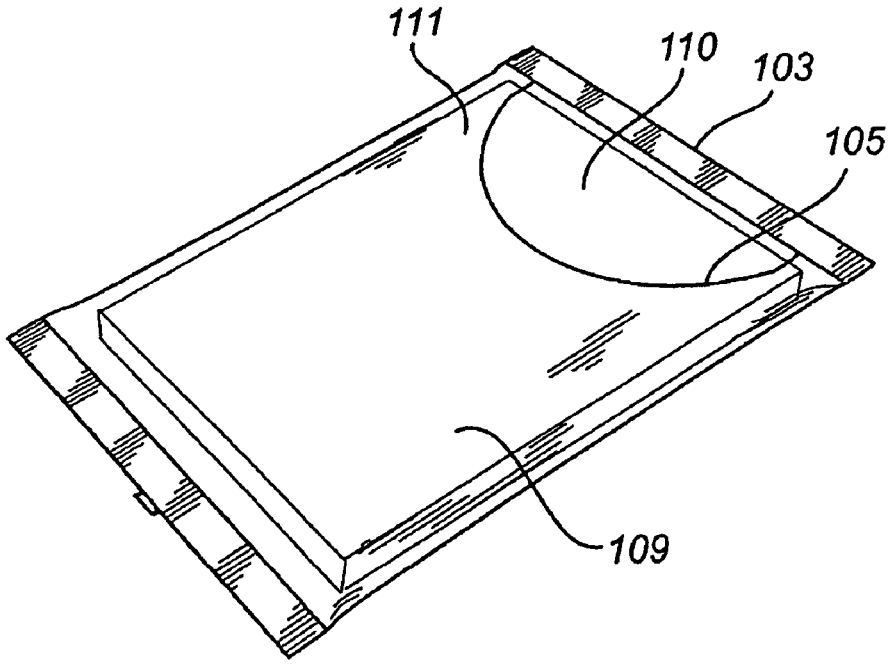
(Prior art) Fig. 2

FLEXIBLE PACKAGE AND METHOD OF PRODUCING THE SAME

FIELD OF THE INVENTION

The present invention relates to a flexible package formed by a wrapped material having a first longitudinal joint comprising two longitudinal edge portions of the wrapped material and a first and a second transverse joint, each comprising a transversal edge portion of the wrapped material. The package comprises a pocket defined by said wrapped material, an openable flap defined by an indication, and a label fixed to the openable flap and provided with a tab for opening the package along the indication. The invention also relates to a method of producing such flexible package.

BACKGROUND ART

Flexible packages of the type 'flow pack' are well known. In their simplest form they are formed by wrapping a continuous web of material about its longitudinal axis and then joining the longitudinal edges of the web so that they form a joint extending along the longitudinal axis of the web. The wrapping is made around the intended contents. The thus formed tube is partitioned off to form a closed pocket by means of upper and lower transverse joints. A package of this type can also be made by wrapping the material into a tube which is partitioned off to form a pocket by means of a first transverse joint forming the bottom thereof. The pocket is filled with its contents and closed by means of a second transverse joint forming the top thereof.

One way of opening this type of package is by tearing off a corner or tearing apart one of the trans-verse joints. Such opening is difficult to control, since the material in the worse case scenario is torn in an uncontrolled manner, fully destroying the package. Also, it does not allow for resealing.

Resealable packages of this type using a flap and seal are known. A typical flap, indication and label are disclosed in U.S. Pat. No. 4,874,096. The package is a 'flow-pack' having an arcuate indication which defines the flap. The flap is covered by a resealable label. Further examples of documents describing this type of packages are WO86/06350 and EP 0 193 130.

The typical solution in these prior art resealable packages is to provide a flap in the package wall whose delimitation corresponds to the desired opening. The delimitation consists of an indication, which may be an area of locally thinner material, a perforation or a through slit. A self-adhesive label covers the flap and the indication. The indication, combined with the self-adhesive label, gives the package a controlled opening geometry and an opening that can be easily resealed. This solution however requires the indication to be smaller than the width or length of the package, depending on the orientation of the flap, since the label must cover, not only the indication, but also an area surrounding said indication. This involves problems to be explained below.

In the filled condition the walls of the package will conform to, and more or less follow the geometry of the object. Accordingly, also the indication and the label will conform to the geometry, making the width of the package and the opening seen in a horizontal plane more narrow. Supposing the object is a rectangular parallelepiped, there is a risk when pulling out the object through the opening, that the object will get stuck inside the package since the opening is too small. Even if it is possible to pull out the object, there is a risk that the corners of the object will tear the material and destroy the package. There is also a risk of damaging the object. The latter is especially the case if the object is easily damaged or rigid, e.g. slices of cheese or a printed circuit card.

One way to solve this is to increase the size of the package compensating for the conforming to the contour of the object. However, a larger package means superfluous use of material and a flapping, generally less aesthetic look.

It is admittedly possible for the indication to cover the full, or almost full width or length of the package. However, in that case the label must be applied and folded over from one wall to the other. This is especially the case if the label should cover the full extent of the indication, including any tearing lines that are formed during opening. Such label is hard to apply in high-speed production. There is a risk that the conformation of the side walls to the geometry of the object creates tensions damaging the indication, and it is hard to reseal the package. Further, if the indication is arranged in the longitudinal direction, there is no natural stopping means when tearing the material, unless the longitudinal joint, which generally is applied on the back wall, is repositioned in accordance with the desired shape and orientation of the flap.

Based on the above discussed problems, packages of the 'flow pack' type are generally not used for easily damaged or rigid objects where access to the full width or length is required through the opening. Instead different types of flexible or rigid deep drawn packages are used having a lid-like closure. This type of packages allow an opening to be formed across the full width/length or area of the mouth of the deep drawn package. This is however a type of package being different from the 'flow pack' type.

OBJECTS OF THE PRESENT INVENTION

One object of the present invention is to provide a flexible package of the 'flow pack' type allowing for a opening across the whole width or length of the package, no matter if the package is filled or not.

A second object of the present invention is to provide such resealable package.

A third object is the provision of a flexible package of the 'flow pack' type having an essential three-dimensional volume even in its unfilled condition.

Yet another object is the provision of a flexible package that can be produced in existing machinery, requiring no or minor rebuilding.

Still another object is provision of a method of producing such flexible package.

SUMMARY OF THE INVENTION

To achieve at least one of the above objects, and also other objects that will appear from the following description, an apparatus and a method having the features defined in claims 1 and 18 are provided according to the present invention.

A number of geometrical terms will be used to describe the invention. The terms upper, lower, top and bottom do all relate to a rectangular package viewed in a vertical, up-right standing position. The term longitudinal relates to the vertical axis of such standing package, but also the feeding direction of a continuous web of material. The term transverse relates to the horizontal axis of a standing package, but also to the direction perpendicular to said feeding direction. Said upright standing package has a back wall and a front wall. The latter, unless nothing else is given, is provided with a label and an indication for opening and resealing the package. By width is meant the measure in the transversal direction of the up-right standing package, or a rectangular parallelepiped object contained in said package.

The term borderline includes a borderline formed by a weld, but also a borderline that can be formed by a fold.

More specifically, the invention relates to a flexible package formed by a wrapped material having a first longitudinal joint comprising two longitudinal edge portions of the wrapped material and a first and a second transverse joint, each comprising a transversal edge portion of the wrapped material, comprising a pocket defined by said wrapped material, an openable flap defined by an indication, and a label fixed to the openable flap and provided with a tab for opening the package along the indication. The flexible package is characterised by a first and a second longitudinal stiffener being formed by said wrapped material, and that said label is adhesively fixed to at least one of said first and second longitudinal stiffeners.

A flexible package of this type is a 'flow pack' having an interior volume which is defined by the inner envelope surface of the wrapped material. Also it has a front wall and a back wall, each being defined by the inner borderlines of the transversal joints, the longitudinal joint and the longitudinal stiffeners. The package allows for an indication to be arbitrary arranged between or within the borderlines of said joints and stiffeners, preferably on the front wall.

By the stiffeners, the package receives a generally three-dimensional volume even in its unfilled condition. The volume can during production be adapted to the volume and geometry of the contents. More precisely, the volume is determined by the distance between inner borderlines of the stiffeners on the front wall and the back wall of the package, respectively. When producing the package said distance on the front wall can be adapted to the width of the object to be contained in the package. Also, the distance on the back wall can be adapted to correspond to the width plus twice the thickness of the object to be contained in the package. By arranging, by way of example, an indication extending between the inner borderlines of said stiffeners, the package will in an opened condition receive an opening extending across the full width of the package and also the full width of the object. Also an opening corresponding to the size of the front wall is possible. Unlike a prior art 'flowpack', full control of the size and position of the opening is achieved.

The stiffeners form a generally flat surface extending outside the inner borderlines.

By the label being adhesively fixed to at least one of the first and second longitudinal stiffeners an opening is allowed to be formed across the full width or length of the package. Also, it allows an opening to be formed across the full front wall area. Further, it allows for the opening to be easily resealed since the stiffeners form an attachment surface for the label being positioned outside the opening, although the latter extends across the full front wall surface.

The label can be attached to this surface to cover the full extent of the indication and any tearing lines that are formed during opening. Thereby, the flap together with the label form a lid by which the package, although being provided with an opening across the whole front wall surface, can be resealed.

Further, the inner borderlines of the stiffeners will act as guiding means which will guide the tearing of the material towards one of the two transversal joints or the longitudinal joint, depending on the actual orientation of the indication. The joint(s) will act as natural stopping means for further tearing. Thus, the flap that results when opening the package will be defined by the indication, the tearing lines along the inner borderlines of the stiffeners and the inner borderline of the joint being arranged in the pulling direction.

Supposing the package is made to be opened by pulling the flap towards one of the transversal joints, a package of this type allows an opening to be formed not only across the full width of the package, but also across the full transversal cross section of the package. Thereby an object contained in the package can be pulled out in the longitudinal direction without being stopped by any wall portions. This is made possible by turning the flap more than 180 degrees around e.g. the transversal joint.

The package is easily resealable by simply pulling back the flap to its original position covering the opening and pressing it against the package.

Further, the front wall together with the stiffeners provide a generally flat surface which is excellent for application of a print or label.

The stiffeners can in their simplest form be formed by folding and welding the material. Such operation can be made outside the machinery. Thus, there is no need for any new machinery, but existing machinery can be used with no or minor re-building.

The stiffeners can extend over the full length of the material. This allows for a continuous production of not only packages as such but also prefabrication of a continuous web of material provided with stiffeners that can be rewound as intermediate goods. It is possible for one of said stiffeners to comprise said longitudinal joint. In the context of this invention, a joint is formed by joining at least two edge portions of the material to provide a closed package. A stiffener primarily provides a surface to which the label can be attached. Further, a stiffener provides rigidity and volume to the package.

In one embodiment said first and second longitudinal stiffeners and said first and second transverse joints define a front surface area having an area which is less than half of the total surface area of the pocket. Thereby, the package will expand a three-dimensional volume even in its unfilled condition. Also, it is possible to adapt the front surface area, i.e. the front wall, to the front surface area of the object to be contained in the package, and especially to its length or width. In the optimal package for a parallelepiped object, the circumference of the wrapped material seen in a transverse cross section of the package corresponds to the circumference of said object. Further, in said optimal package the distance between the borderlines of the two stiffeners on the front wall corresponds to the width or length of said object depending on the intended orientation of the object inside the package.

The label can be adhesively fixed to the wrapped material over the full extension of the indication for the purpose of resealably sealing the package after opening. It is to be understood that the possibility of resealing is depending on the type of adhesive, i.e. if self-adhesive or not.

The indication can have any suitable extension, preferably between said first and second stiffeners, between said first and second transverse joints, or between one of said first and second longitudinal stiffeners and one of said first and second transverse joints. In its simplest form, the extension is straight or arcuate. The indication must not extend the full final extent of the desired opening. The length can be the combined length of the indication and the tearing lines formed during opening.

Also, the indication can extend from the inner borderline of the first longitudinal stiffener to the inner borderline of the second longitudinal stiffener, from the inner borderline of the first transverse joint to the inner borderline of the second transverse joint, or from the inner borderlines of one of said first and second longitudinal stiffeners to the inner borderlines of one of said first and second transverse joints. By letting the indication extend from one borderline to another, the material during tearing when opening the package is allowed to follow and be guided along the borderlines. This results in a well controlled opening. It also results in an opening covering the full width of the package allowing objects to be pulled out from the opened package in the vertical or longitudinal direction without interference with any wall portions. Thus, an opening covering the full front wall area is possible.

Further, depending on the extension selected, the label can further be adhesively fixed to at least one of said first and second transverse joints.

It is possible for the package to comprise at least a third longitudinal stiffener, and that each longitudinal stiffener, viewed in a transverse cross section, define an inner corner of said package. This allows the inventive package to have a prismatic cross section when viewed in the transverse direction.

In one embodiment the endpoints of said indication are arranged within a distance from the inner borderlines of any of said longitudinal stiffeners, longitudinal joint or transversal joints. The distance can be 0-5 mm, preferably 1-4 mm and most preferred 2-3 mm. During opening of the package by pulling the label, the package will initially open along the indication. If further pulled, the material will be torn along a tearing line which strives towards and follows the inner borderlines. This provides an opening across the full width or length of the package although said initial distance. The longitudinal stiffeners, longitudinal joint or transversal joints will act as natural stopping means for further tearing. Further, the distance allows for slight misalignment of the material in the machine during production of packages.

In one embodiment the longitudinal stiffeners comprise two adjoined wall portions of said wrapped material. This can by way of example be made by folding the material or by joining two or more webs or sheets of material along their longitudinal edges.

In another embodiment the longitudinal stiffeners form a generally flat surface extending outside inner borderlines of said stiffeners, wherein the label is attached to this surface covering the full extent of the indication and any tearing lines that are formed during opening of the flexible package.

According to another aspect, the invention relates to a method for producing a flexible package of a wrapped material comprising the steps of providing an indication in the material, which indication defines an openable flap, wrapping the material about a longitudinal axis, such that two longitudinal edge portions of the material makes contact, joining the two longitudinal edge portions in a longitudinal joint and delimiting a pocket by forming a first and a second transverse joint. The method is characterized by the steps of providing a first and a second longitudinal stiffener being formed by said material and adhesively positioning a label on the openable flap and on at least one of said first and second longitudinal stiffeners, which label is provided with a tab for opening the package along the indication.

The method, generally claiming the same features as those relating to the flexible package, benefits from the same advantages as those already mentioned above. This also applies to the dependent method claims.

Especially, the wrapped material can be pre-prepared with said longitudinal stiffeners, or the stiffeners can be provided when entering the machinery or during processing in the machinery. Further, the material can be provided in the form of a continuous web or in the form of individual sheets. Thus, there is no need for any new machinery, but existing machinery can be used with no or minor re-building. Also, the user can, within the scope of the claimed method, use a material being composed of one or several materials, structures, thicknesses, colours etc. This allows, by way of example, production of a package having a front wall of a thin transparent plastic foil and a back wall of an embossed plastic foil being coloured throughout.

DESCRIPTION OF DRAWINGS

The invention will now be described in more detail by way of example and with reference to the accompanying drawings.

FIG. 1 illustrates a resealable 'flow pack' according to prior art containing a rectangular parallelepiped object. The package is unopened.

FIG. 2 illustrates the package according to FIG. 1 in an opened condition.

DESCRIPTION OF PREFERRED EMBODIMENTS

Figure 3:
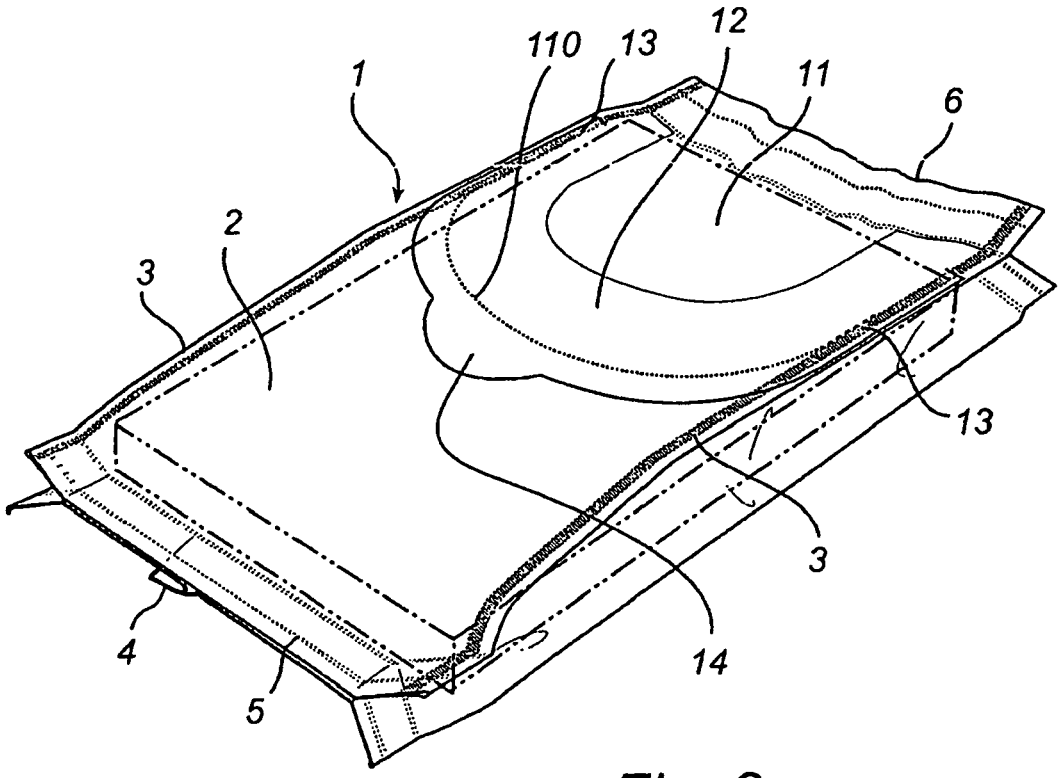
FIG. 3 illustrates a first embodiment of the package according to the invention. The package is illustrated in an unopened condition containing a rectangular parallelepiped object.

For improved understanding of the invention, reference is made to FIG. 1, disclosing a typical prior art resealable package 100 in an unopened condition. The disclosed package 100 is generally known as a 'flow pack'.

The package 100 is made (not shown) by wrapping a continuous web of material about its longitudinal axis and joining the longitudinal edges of the material so that they form a joint 101 extending along the longitudinal axis of the web material. The web of material thus joined is partitioned off to form a pocket by means of a lower transverse joint 102 forming the bottom thereof. The pocket is filled and closed by means of an upper transverse joint 103 forming the top thereof, before the finished package 100 is separated.

The package 100 has an openable flap 104 defined by an indication 105 being punched in the material.

The indication 105 is covered by a label 106 which on its surface facing the package is provided with an adhesive. The label 106 is resealably adhered to the package 106 so that the package can be opened and resealed repeatedly.

The indication 105 in the prior art package 100 of FIG. 1 has an extension within the peripheral borderlines 107 of the package 100, when the package is seen in a flat, unfilled condition (not disclosed). Further, the borderlines 108 of the label 106 covering the indication 105 are arranged within the same peripheral borderlines 107 of the package 100. As is schematically illustrated in FIG. 1, the package 100 contains a rectangular parallelepiped object 109. The front and back walls of the package 100, and thus the indication 105 and the label 106, are roughly conforming to the geometry of the object 109, i.e. the object expands the package to a three-dimensional geometry. Without contents a prior art 'flow pack' is more or less two-dimensional.

With reference to FIG. 2 the prior art package 100 of FIG. 1 is schematically illustrated in an opened state. For enhanced understanding, the flap and label are removed, whereby only the opening 110 defined by the indication 105 is shown.

When lifting and pulling the flap (not shown) for opening the package along the indication, the material in the indication 105 and the front wall is torn in the pulling direction, i.e. in the illustrated package towards the upper transverse joint 103. The transverse joint acts as a stopping means preventing further tearing.

In FIG. 2 it is shown that conformation of the walls to the geometry of the object 109 makes the opening 110 smaller than the width of the object 109. When pulling out the object 109 through the opening 110, its corners will consequently be stopped by the front wall 111. If the object has sharp corners or edges, they might damage the front wall or affect the possibility to resealably close the package. In the worse case scenario, the object might be damaged.

Now referring to FIG. 3, a first embodiment of the package 1 according to the invention is disclosed.

The package has two opposing side walls, i.e. a front wall 2 and a back wall (not shown), being formed by wrapping a continuous web of material along its longitudinal axis. Before, or during this wrapping, two longitudinal stiffeners 3 are formed. In their simplest form, the stiffeners are formed by folding and subsequent welding. The material and the forming of the stiffeners 3 will be discussed in detail below.

Further, the longitudinal edges of the wrapped material are joined by welding so that they form a longitudinal joint 4 extending along the longitudinal axis of the web. The tube thus formed is partitioned off to form a pocket by means of a first lower transverse joint 5 forming a bottom of the package 1 and an second upper transverse joint 6 forming a top of the package. Finally, the finished package is separated.

The longitudinal joint 4 as well as the transversal joints 5, 6 are preferably formed by welding. Also, adhesive can be used. The longitudinal joint 4 is preferably arranged on the back wall of the package.

Said wrapping can be made around the intended contents. The contents can also be filled in the pocket being formed by wrapping before the second transverse joint is formed. The first option is suitable for rigid objects, whereas the second option is suitable for unstable or low-viscous contents.

Figure 4:
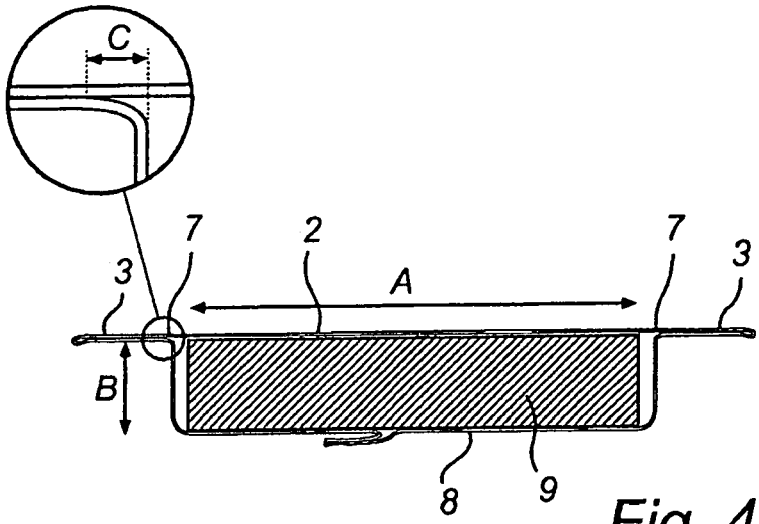
FIG. 4 discloses a transversal cross-section of the package of FIG. 3.

The longitudinal stiffeners 3 are positioned asymmetrically around the envelope surface of the package when seen in the transverse direction, see FIG. 4. By way of example the distance between the inner borderlines 7 of the stiffeners 3 on the front wall 2 is smaller than the distance between the inner borderlines 7 of the stiffeners 3 on the back wall 8. This difference makes the package expand a volume even in its unfilled condition.

It is to be understood that the distances between the inner borderlines 7 on the front wall 2 and back wall 8 preferably are adapted to the geometry of the object 9 intended for the package. By way of example, if the object 9 has a rectangular, transversal cross section, having a width A and a thickness B, see FIG. 4, the distance between the inner borderlines 7 on the front wall 2 substantially corresponds to the measure A, whereas the distance between the inner borderlines 7 on the back wall 8 substantially corresponds to the measure A+2B. This will provide a package 1 having a substantially flat front wall 2. Also, by this design the stiffeners 3 tend to be forced by the object into a generally horizontal direction extending in the same plane as the front wall 2.

In FIG. 4 the longitudinal stiffeners are arranged in the same plane as the front surface. However, the longitudinal stiffeners can also be arranged in a plane being different from the plane of the front surface.

Now referring to FIG. 3, the package 1 is openable and resealable by an indication 10 defining a flap 11 and a label 12 covering said indication 10. The arcuate indication 10 is formed on the front wall 2. The indication 10 extends between the inner borderlines 7 of the stiffeners 3.

The label 12 is applied on the front wall 2 covering the extent of the indication 10, but also an area surrounding said indication. More precisely, the label 12 is attached to the front wall 2 covering the extent of the indication 10, but also a portion 13 of the stiffeners 3 adjacent the indication. The portion 13 of the stiffeners 3 covered by the label 12, in the following to be referred to as bonding surface 13, preferably extends in the longitudinal direction corresponding to not only the longitudinal extent of the indication 10, but also the longitudinal extent of the tearing line (not shown) along the borderline of the stiffener. The tearing line is formed when opening the package and will be described in detail below with reference to FIG. 5. Thereby, after opening, the package can be fully re-sealed when closing the package by pressing the self-adhesive label against the bonding surfaces 13 on the stiffeners 3 and the front wall 2. The bonding surfaces 13 and the stiffeners 3 preferably have a width that is enough to provide for a satisfying resealing. The width of the bonding surfaces 13 may correspond to or be smaller than the width of the stiffeners 3.

In case of a resealable package 1, the adhesive should be self-adhesive.

The label 12 further has a gripping tab 14 provided along one edge. The gripping tab 14 is preferably adhesive free or adhesively killed.

Figure 5A:
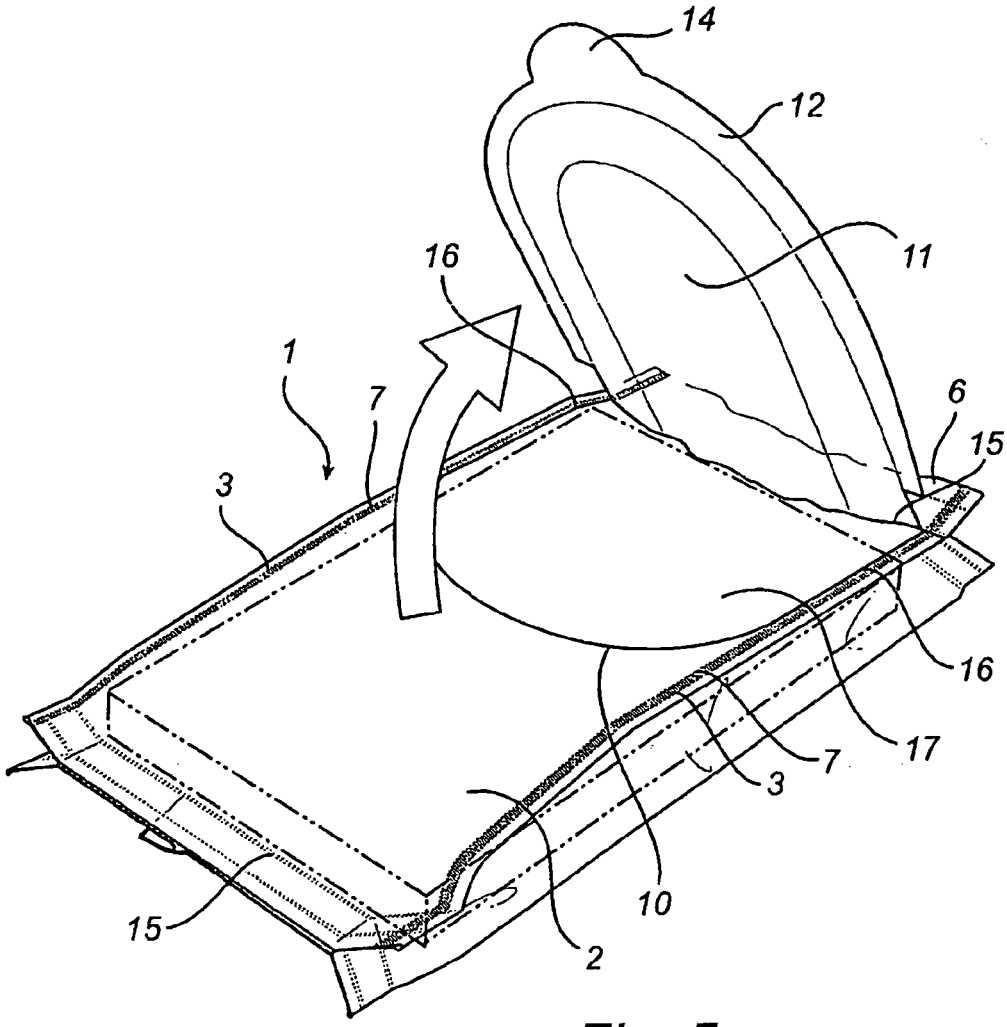
FIG. 5*a* discloses the package of FIG. 3 in an opened condition.

Now turning to FIG. 5*a*, the package 1 according to FIG. 3 is illustrated in an opened condition. The package 1 is opened by gripping the tab 14 and pulling the flap 11, whereby the package 1 is opened along the indication 10. During opening the material is torn in the pulling direction towards the inner borderline 15 of the upper transverse joint 6, which acts as a stopping means preventing further tearing. Since the end-points of the indication are arranged close to the inner borderlines 7 of the stiffeners 3 the material will be torn along these borderlines 7 which act as guiding means. Thus, depending on the extent of the indication 10, the material may not only be torn along the indication 10, but also along tearing lines 16. The flap 11 is thus defined either by the indication 10 alone or by a combination of the indication 10 and the resulting tearing lines 16. The thus opened package 1 will have a opening 17 covering the full width of the package 1.

The package 1 is easily resealable, by simply pulling back the flap 11 and pressing it against the bonding surfaces 13 and the front wall 2. The resealing effect is achieved by the label being self-adhesive.

Although the illustrated package 1 has en indication 10 extending between the inner borderlines 7 of the longitudinal stiffeners 3 on the front wall 2 of the package 1, it is to be understood that the indication 10 also can be arranged extending between the inner borderlines 15 of the transverse joints 5, 6, between the inner borderlines of a first or a second transverse stiffener (not shown) and a first and a second transverse joint 5, 6, respectively. Thus, the indication 10 can have an arbitrary extent within or between the inner borderlines of said longitudinal or transversal stiffeners and said transverse joints. This applies to any wall of the package, i.e. the front wall as well as the back wall or any wall in a package having a prismatic shaped transversal cross section.

Figure 5B:
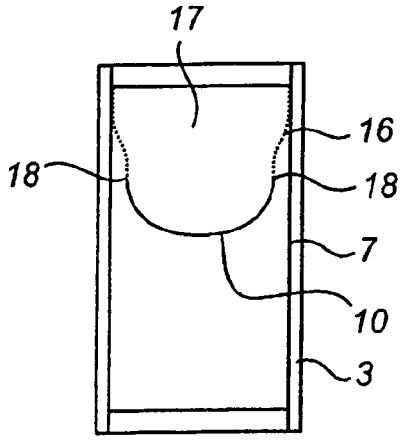
FIG. 5*b* highly schematically discloses a front plan view of the package illustrating the indication and tearing lines striving towards the inner borderlines of the stiffeners.

With reference to FIG. 5*b*, the endpoints 18 of the indication 10 are preferably in an unopened package arranged within a distance from the inner borderlines 7 of any of said longitudinal stiffeners, longitudinal joint or transversal joints. The distance can by way of example be 0-5 mm, preferably 1-4 mm and most preferred 2-3 mm As has been defined above, the term borderline includes a weld line but also a line that can be formed by a fold. More precisely, a stiffener is preferably formed by folding and subsequently welding the surface. Depending on the tolerance or the design of the weld a small gap C, see FIG. 4 can be formed in the overlapping area along the extent of the stiffener. Said distance 0-5 mm should include such gap.

During opening, the tearing line 16 will strive towards and follow the inner borderlines 7, whereby an opening 17 will be formed across the full width or length of the package 1.

The material of the package 1 can be any type of flexible material suitable for the intended purpose and use of the package. The material can by way of example be plastics, paper or metal, or laminates comprising layers thereof. Also, one and the same package can have walls or wall portions each being made of different materials. The material can have a molecular orientation providing for the material to be torn in a specific direction.

As is mentioned above, the package 1 is made of a wrapped material. The material can be in the form of a sheet, or more preferred in the form of a continuous web. The continuous web can be formed as a single web, or being a web that is made of one or several longitudinally joined webs. Each web can have a desired quality, thickness, structure, material or colour.

Figure 6A:
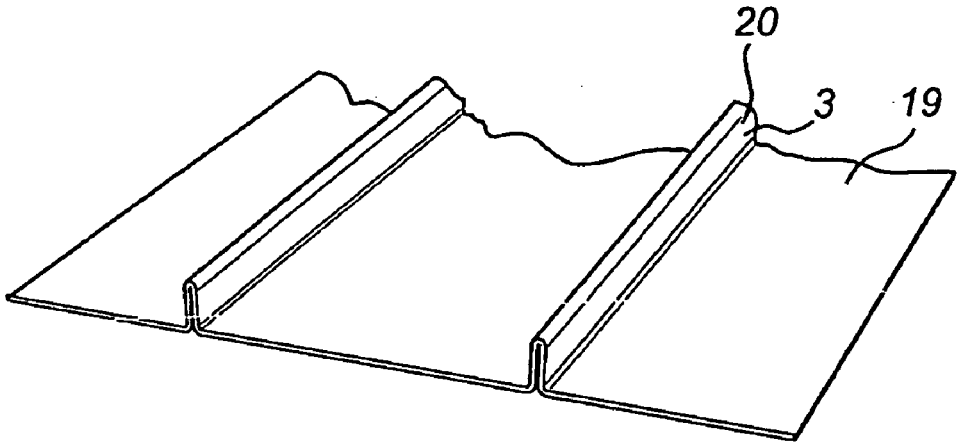
FIGS. 6*a*-6*c* discloses schematically, three embodiments of a continuous web of material before wrapping.
Figure 6B:
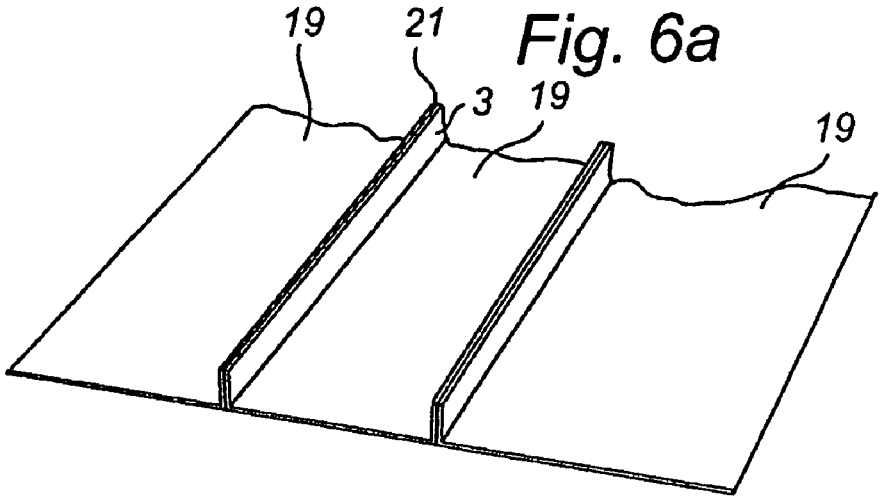
Figure 6C:
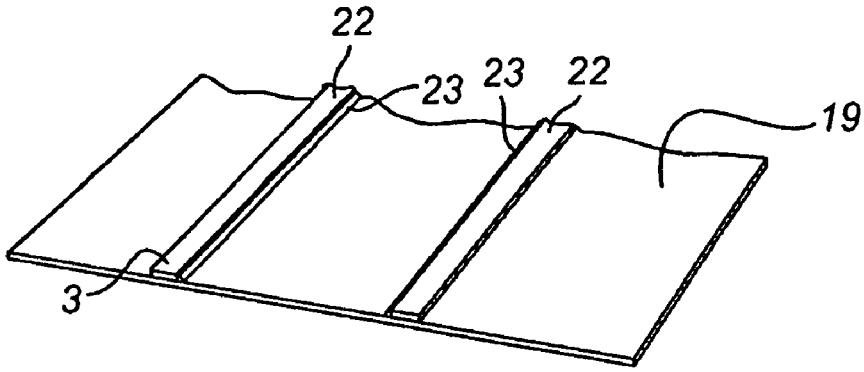

Depending on the design of the continuous web, the stiffeners can be made in a number of ways, of which three embodiments are schematically illustrated in FIGS. 6*a*-6*c*.

Referring to FIG. 6*a* a first embodiment is disclosed wherein longitudinal stiffeners 3 are formed in a single continuous web 19 by forming longitudinal folds 20. In the folds 20 the adjoining inner surfaces are welded together. The stiffeners 3 are formed before wrapping.

Referring to FIG. 6*b* a second embodiment is disclosed wherein stiffeners 3 are formed by joining three continuous webs 19 along their longitudinal edges 21 by adjoining, preferably by welding, the inner walls of said webs. Thereby, two longitudinal stiffeners 3 are formed. The stiffeners 3 are formed before wrapping.

Referring to FIG. 6*c* a third embodiment is disclosed in which a continuous web 19 is provided with stiffening narrow strips 22, one for each stiffener 3 to be formed, in the longitudinal direction of the web. The strips 22 are preferably attached along one of their longitudinal edge portions 23 by a stitch weld or a roller seam weld.

When wrapping the material, the stiffeners of the three embodiments will extend in an outward direction on the outer face forming two generally flat surfaces extending in the longitudinal direction.

It is to be understood that the stiffeners 3 can be made in a numerous ways, all falling within the scope of the invention.

It is also to be understood that the number of stiffeners and webs joined depends on the desired shape of the package and the desired number of stiffeners. By way of example, a package having a prismatic transversal cross section can be made by forming one longitudinal stiffener for each corner of the prismatic cross section. Thus, each stiffener define an inner corner of the package.

The stiffeners can be formed as a step in a continuous process of manufacturing packages or as a separate operation for preparing rolls of material for later processing.

The indication is preferably formed and covered by a label after forming the stiffeners, but before wrapping the material to form a package.

The indication is preferably formed by punching an indication in the web of material. The indication may be a continuous through slit, a perforation or an indentation. The form of the indication will be dependent on, for example, the design and the size of the flap, the step of the manufacturing process in which the indication is formed as well as the packaging material.

After forming the indication, the indication is covered by applying a label covering not only the extension of the indication, but also an area surrounding the indication. For provision of a tight seal the label should be applied covering not only the full extent of the indication but also the tearing line that is formed when opening the package. It is to be understood that the label also can be applied over a limited extent of said indication. The label is also applied to cover a portion of the stiffeners. Thereby the package can be fully resealed although an opening is formed across the full width, length or full front wall surface.

Figure 7A:
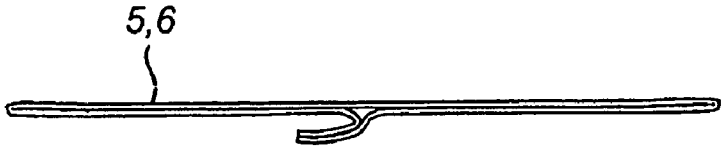
FIGS. 7*a*-7*c* schematically discloses three embodiments of a transversal joint in cross section.
Figure 7B:
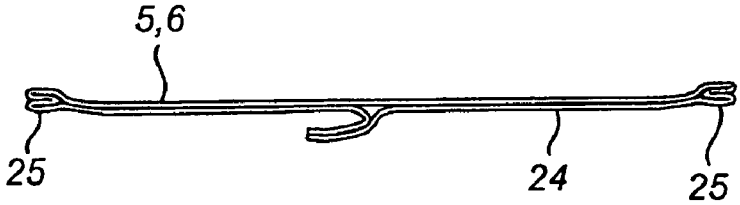

In the simplest form the transverse joints 5, 6 are formed by arranging a welding nip in the transverse direction across the wrapped material. Such transverse joint 5, 6 is schematically illustrated in FIG. 7*a*. In case the front wall and back wall have different trans-verse distances between the inner borderlines of the stiffeners, i.e. the front wall is wider than the back wall, it is preferred that a tool acting in the trans-verse direction is used before welding for forming a longitudinal 'soft' fold in the widest wall, i.e. preferably the back wall. Such fold should be provided at least in the region close to the transversal joint. This fold will provide for the transversal joints to receive a width essentially corresponding to the total width of the front wall and the two longitudinal stiffeners. This will result in a transversal joint 5, 6 having one central portion, having twice the thickness of the sheet material and two edge portions, one on each side of the central portion, having a thickness equal to four times the thickness of the sheet material, see FIG. 7*b*.

Figure 7C:
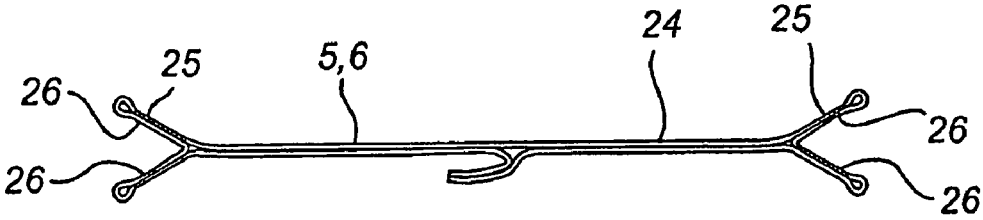

However, depending on the design of the welding nip, the transverse joint 5, 6 can also be formed as is disclosed in FIG. 7*c*. A central portion 24 is formed having a thickness twice the thickness of the material. Two edge portions 25, one on each side of the central portion, are formed as two flanks 26, each having a thickness twice the thickness of the edge portion. Thus, each end portion 25 together with the central portion 24 form a cross section in the form of letter Y.

It is to be understood that the thickness of any welded or otherwise formed joint, i.e. the longitudinal joint, the transverse joints and the longitudinal stiffeners in practice will have a thickness slightly smaller than the sum of layers of material in the joint due to a thickness reduction occurring during welding.

Figure 8:
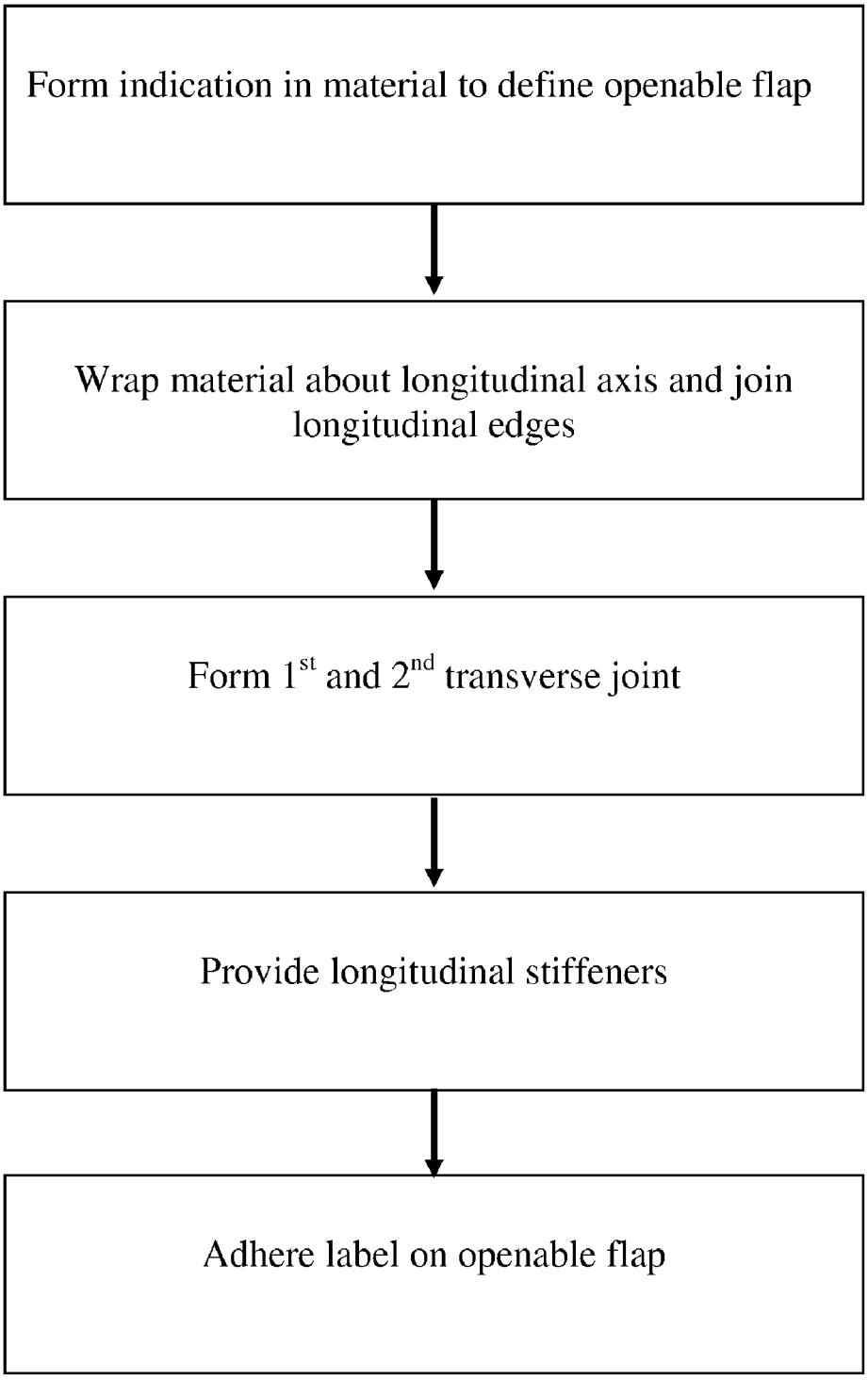
FIG. 8 is a flow chart of the method used to produce the package.

The method of forming the package is depicted in the flow chart of FIG. 8. Although the package generally has been disclosed as being made by wrapping a continuous material along its longitudinal edges, it should be understood that a package within the scope of protection also can be formed by putting together, either two continuous webs of packaging material or two sheets, on top of each other and then delimiting a pocket by forming a circumferential joint. Before the webs or sheets are put together, at least one of them are being provided with longitudinal stiffeners, an indication and a label.

Generally in the description the longitudinal joint has been disclosed and discussed as a joint being different from the longitudinal stiffeners. In one possible embodiment, not disclosed, the longitudinal joint can constitute one of the at least two longitudinal stiffeners. In that case, said longitudinal joint should preferably not be arranged on the back wall, but should instead together with the inner borderline of the longitudinal stiffener delimit a back wall and a front wall.

The longitudinal stiffeners, the longitudinal joint and the transversal joints can be made more rigid by embossing or twice folding.

It is to be understood that although the invention has been disclosed with longitudinal stiffeners extending along the full length of the container, the longitudinal stiffeners may have an intermittent extension.

Although not illustrated, the label is preferably provided with some sort of guarantee seal.

The invention has been illustrated as having an indication that provides for an opening at one portion of the package allowing the contents to be pulled out generally in the longitudinal direction. It is to be understood that the invention also allows for an opening that covers essentially the full front wall area of the package, i.e. the area defined by the inner borderlines of the longitudinal stiffeners and the transversal joints. This is very useful if full access to the contents is desired from a direction perpendicular to the longitudinal direction. By way of example such package is very useful for hard cheese, whereby the cheese may be sliced in the horizontal direction by using a cheese slicer while still being positioned in the package. When finished, the package can be resealed by pressing the label against the stiffeners.

It will be appreciated that the present invention is not limited to the shown and described embodiment of the invention. Several modifications and variants are thus conceivable, and consequently the invention is defined exclusively by the appended claims.

The invention claimed is:

1. A flexible package formed by a wrapped material having a first longitudinal joint comprising two longitudinal edge portions of the wrapped material and a first and a second transverse joint, each comprising a transversal edge portion of the wrapped material, comprising:

a top wall and a pair of side walls extending downwardly from the top wall, a pocket defined by said wrapped material, an openable flap defined by an indication, a label fixed to the openable flap and provided with a tab for opening the package along the indication, and a first and a second longitudinal stiffener being formed by said wrapped material, the stiffeners extending outwardly from the side walls, wherein said label is adhesively fixed to at least one of said first and second longitudinal stiffeners.

2. The flexible package according to claim 1, wherein said stiffeners extend over the full length of the material.

3. The flexible package according to claim 1, wherein one of said stiffeners comprise said longitudinal joint.

4. The flexible package according to claim 1, wherein said first and second longitudinal stiffeners and said first and second transverse joints define a front surface area having an area which is less than half of the total surface area of the pocket, and that said indication and label are located on said front surface.

5. The flexible package according to claim 1, wherein said label is adhesively fixed to the wrapped material over the full extension of the indication for the purpose of resealably sealing the package after opening.

6. The flexible package according to claim 1, wherein said indication extends between said first and second longitudinal Stiffeners.

7. The flexible package according to claim 6, wherein said indication extends from the inner borderline of the first longitudinal stiffener to the inner borderline of the second longitudinal stiffener.

8. The flexible package according to claim 1, wherein said package comprises in addition at least a third longitudinal stiffener, and that each longitudinal stiffeners viewed in a transverse cross section, define an inner corner of said package.

9. The flexible package according to claim 1, wherein endpoints of said indication are arranged within a distance from the inner borderlines of any of said longitudinal stiffeners, longitudinal joints or transversal joints.

10. The flexible package according to claim 1, wherein endpoints of said indication are arranged within a distance of 0-5 mm from the inner borderlines of any of said longitudinal stiffeners, longitudinal joint or transversal joints.

11. The flexible package according to claim 1, wherein the first and longitudinal stiffeners comprise two adjoined wall portions of said wrapped material.

12. The flexible package according to claim 1, wherein the longitudinal stiffeners form a generally flat surface extending outside inner borderlines of said stiffeners, wherein the label is attached to this surface covering the full extent of the indication and any tearing lines that are formed during opening of the flexible package.

13. A method for producing a flexible package of a wrapped material, comprising:

providing an indication in the material, which indication defines an openable flap, wrapping the material about a longitudinal axis, such that two longitudinal edge portions of the material makes contact, joining the two longitudinal edge portions in a longitudinal joint, delimiting a pocket by forming a first and a second transverse joint top form a top wall and a pair of side walls extending downwardly form the top wall, providing a first and a second longitudinal stiffeners being formed by said material, the longitudinal stiffeners extending outwardly from the side walls, and adhesively positioning a label on the openable flap and on at least one of said first and second longitudinal stiffeners, which label is provided with a tab for opening the package along the indication.

14. The method according to claim 13, wherein said stiffeners are provided over the full length of the material.

15. The method according to claim 13, wherein said longitudinal joint constitutes one of said longitudinal stiffeners.

16. The method according to claim 13, wherein said first and second longitudinal stiffeners and said first and second transverse joints are provided such that they define a front surface area having an area which is less than half of the total surface area of the pocket, and that said indication and label are located on said front surface.

17. The method according to claim 13, wherein said label is positioned over the indication.

18. The method according to claim 13, wherein said indication is provided such that it extends between said first and second longitudinal stiffeners.

19. The method according to claim 13, wherein said indication is provided such that it extends from the inner borderline of the first longitudinal stiffener to the inner borderline of the second longitudinal stiffener.

20. The method according to claim 13, wherein at least a third longitudinal stiffener is provided by adjoining two wall portions of said sheet material, whereby each stiffener, when viewed in a transverse cross section, defines an inner corner of said package.

21. The method according to claim 13, wherein endpoints of said indication are arranged within a distance from the inner borderlines of any of said longitudinal stiffeners, longitudinal joint or transversal joints, which distance can be 0-5 mm.

22. The method according to claim 13, wherein said first and second longitudinal stiffeners are formed by adjoining two wall portions of said sheet material.

* * * * *